United States Patent [19]

Schenach

[11] Patent Number: 4,610,121

[45] Date of Patent: Sep. 9, 1986

[54] ROOF CLADDING

[76] Inventor: Wilfried J. Schenach, P.O. Box 26481, Arcadia, Pretoria, Transvaal, South Africa

[21] Appl. No.: 561,656

[22] Filed: Dec. 15, 1983

[30] Foreign Application Priority Data

Mar. 29, 1983 [ZA] South Africa ..... 83/2205
Apr. 18, 1983 [ZA] South Africa ..... 83/2689

[51] Int. Cl.[4] ..... E04D 1/00
[52] U.S. Cl. ..... 52/520; 52/543
[58] Field of Search ..... 52/478, 520, 543, 545, 52/537

[56] References Cited

U.S. PATENT DOCUMENTS

| | | | |
|---|---|---|---|
| 378,725 | 2/1888 | Sagendorph | 52/520 X |
| 892,248 | 6/1908 | Garvin | 52/520 |
| 3,511,011 | 5/1970 | Straus | 52/545 X |
| 4,217,741 | 8/1980 | Cole | 52/520 |
| 4,266,385 | 5/1981 | Oehlert | 52/543 X |
| 4,271,653 | 6/1981 | Buckhorn | 52/520 X |
| 4,467,582 | 8/1984 | Hague | 52/478 |

FOREIGN PATENT DOCUMENTS

| | | |
|---|---|---|
| 1123568 | 11/1982 | Canada . |
| 3030331 | 12/1982 | Fed. Rep. of Germany . |
| 204277 | 6/1982 | PCT Int'l Appl. . |
| 82/03420 | 10/1982 | PCT Int'l Appl. . |
| 693222 | 3/1970 | South Africa . |
| 715058 | 10/1973 | South Africa . |
| 727012 | 12/1973 | South Africa . |
| 732197 | 11/1974 | South Africa . |
| 746288 | 6/1975 | South Africa . |
| 754326 | 5/1976 | South Africa . |
| 763111 | 8/1977 | South Africa . |
| 763911 | 8/1977 | South Africa . |
| 770953 | 6/1978 | South Africa . |
| 771093 | 10/1978 | South Africa . |
| 794563 | 3/1980 | South Africa . |
| 810434 | 1/1982 | South Africa . |
| 810957 | 4/1982 | South Africa . |
| 628409 | 9/1982 | Switzerland . |

*Primary Examiner*—William F. Pate, III
*Assistant Examiner*—Creighton Smith
*Attorney, Agent, or Firm*—Wood, Dalton, Phillips, Mason & Rowe

[57] ABSTRACT

Elongate, profiled roof cladding sheets with formations on opposed edges for interengaging adjacent sheets to facilitate installation and form watertight joints. The interengaged formations form spaces to act as capilliary breaks. Cleats secure one edge only of each sheet to a roof frame and allow thermal contraction and expansion.

3 Claims, 5 Drawing Figures

ROOF CLADDING

BACKGROUND OF THE INVENTION

1. Field of the Invention

This invention relates to roof cladding, a method of installing roof cladding and a roof structure incorporating the roof cladding or made using the method of the invention. This invention is primarily concerned with roof cladding using elongate profiled metal sheets.

2. Description of the Prior Art

According to international standards roof cladding should have a minimum of six fastenings per square meter. This presents problems for non-conventional long span roofing, e.g. 1.5 to 2 meters between purlins, where good weather sealing is to be maintained. In order to avoid holes in the body of each sheet, each sheet must be relatively narrow so that the required number of fastenings can be obtained when the longtudinal edge portions only of the sheets are secured. This places high demands on the installer to ensure good sealing between adjacent sheets while working rapidly. In addition long span roofing is usually used with very long sheets so that the effects of thermal expansion will also have to be catered for. For example, coefficients of thermal expansion of available roof cladding are $1\times10^{-5}/°$ C. for galvanised iron, $3\times10^{-5}/°$ C. for TiZn, and $Z\times10^{-5°}$ C. for aluminium, so that over a 10 m length with a temperature range of 40° C. movements of between 4 and 12 mm may be experienced. Yet other problems are those of lateral wind action and capilliary forces by which rain water, for example, may be forced through or may seep through the joint between roofing sections.

SUMMARY OF THE INVENTION

According to one object of the invention there is provided an elongate, transversely profiled roof sheet comprising at least one elongate ridge and flanking valleys and first and second edge formations along opposed elongate edges of the sheet, the first edge formation including juxtaposed first edge flanks meeting in a bent over flange that forms a lock flange extending inwardly from the first edge flanks and the second edge formation comprising a second edge flank, a bent over crest extending from the second edge flank outwardly from the second edge flank to a reentrant bend forming a groove underneath the bent over crest.

According to another object of the invention there is provided an elongate transversely profiled roof sheet comprising at least one elongate ridge and flanking valleys and first and second edge formations along opposed elongate edges of the sheet, the first edge formation having a first edge flank and a lock flange extending inwardly from an upper region of the first edge flank and the second edge formation comprising a second edge flank, an edge crest extending from an upper region of the second edge flank outwardly from the second edge flank to a reentrant bend forming a groove underneath the edge crest.

The edge formations of adjacent roof sheets can be locked to each other by engaging the lock flange of one sheet in the groove of the other sheet. Preferably the first edge flanks or flank have an upturned lip on their lower outer edge to provide a water run-off channel in case some water does penetrate the joint.

A further object is to provide cleats for securing the roof sheet to a roof frame structure, each cleat being securable to a roof frame member and having a clamp portion for engaging a part of the first edge formation. The cleats make it possible to hold down the roof sheets with freedom for expansion and contraction in the longitudinal direction of the sheet.

In another embodiment the first edqe flanks have a base portion by means of which that edge can be secured to a purlin and the like, for example, by nailing through the base portion. Preferably in this event, an upwardly extending lip is formed on the free end of the base portion so as to form a run-off trough with the base portion and the adjacent flank.

Where a cleat or bracket is provided to fasten the first edge formation to a purlin and the like, the cleat may comprise a base portion for securing the cleat to a purlin, an upwardly extending portion, and a clamp portion including a returned lip for engaging the cleat with a flange of a first edge formation of a roof sheet. Alternately, the cleat may comprise a base portion for securing the cleat to a purlin and a portion for engaging a suitable formation on a first edge rib such as one of a flange, a tab, an edge of a perforation or slot, and a step or land.

Preferably the lock flange slopes downwardly toward the valley of the roof sheet. With this slope when the lock flange is engaged in the groove spaces or plenums are formed to act as capilliary breaks. Preferably an edge lip portion is formed at the free end of the returned lip portion of the second edge rib formation. This edge lip portion is preferably constructed to interfere with the flank of the first edge rib formation of an adjacent sheet to form a space preventing water passing through a joint under the action of wind forces.

According to another object of the invention there is provided a method of installing roof sheeting as described above including the steps of laying a roof sheet on a roof frame, securing the first edge formation of the sheet to the roof frame, positioning a second sheet inclined with respect to the first sheet and engaging the second edge formation of the second roof sheet with the first edge formation of the already installed first roof sheet, twisting the second roof sheet into position, securing the first edge of the second sheet and proceeding optionally with further sheets as required to roof over an area.

According to yet another object of the invention there is provided a roof structure comprising roof sheeting as described above and laid on supporting structure using the method of the invention described above.

Preferred embodiments of the invention are described below with reference to the accompanying drawings.

DESCRIPTION OF THE PREFERRED EMBODIMENTS

Figure 1:
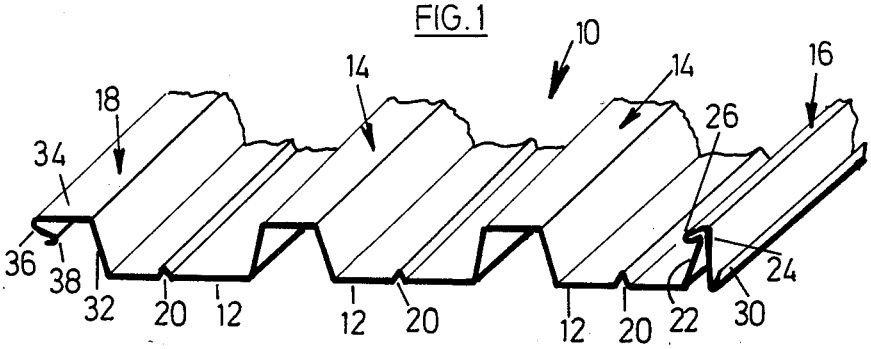
FIG. 1 shows an oblique view of a preferred embodiment of roof sheet of the invention.

FIG. 1 shows a roof sheet 10 which is suitable for "long span" roofing in which the spacing between adjacent supports (purlins) may be as much as 1.5 to 2 m. The sheet I0 has two ridges I4 with flanking valleys 12 and first and second edge formations 16 and I8. Between the ridges 14 and edge formations I6 and 18 are minor stiffening ribs 20. Typically the sheet is 330 mm wide having been formed from 600 mm wide strip.

The first edge formation 16 comprises juxtaposed flank portions 22 and 24 which slope upwardly towards each other and the flanks 22 and 24 are bent over to form a lock flange 26 extending inwardly from the first edge flanks 22 and 24. At the base of the flank 24 there is an upturned lip portion 30 forming a water run-off trough.

The second edge formation 18 comprises a flank 32, a bent over crest 34 extending outwardly from the flank 32, and a reentrant portion 36 the free end of which is turned over to form a lip 38. A groove is formed between the crest 34 and reentrant portion 36.

Figure 1A:
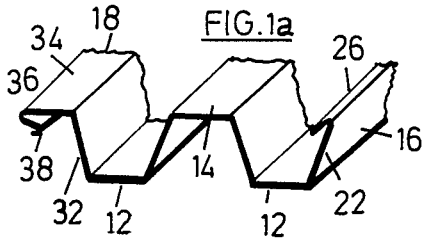
FIG. 1*a* shows an oblique view of an alternative embodiment of roof sheet of the invention.

In FIG. 1*a*, the same reference numerals are used for corresponding parts to those of the sheet shown in FIG. 1, and the sheet is used in analogous manner.

Figure 2:
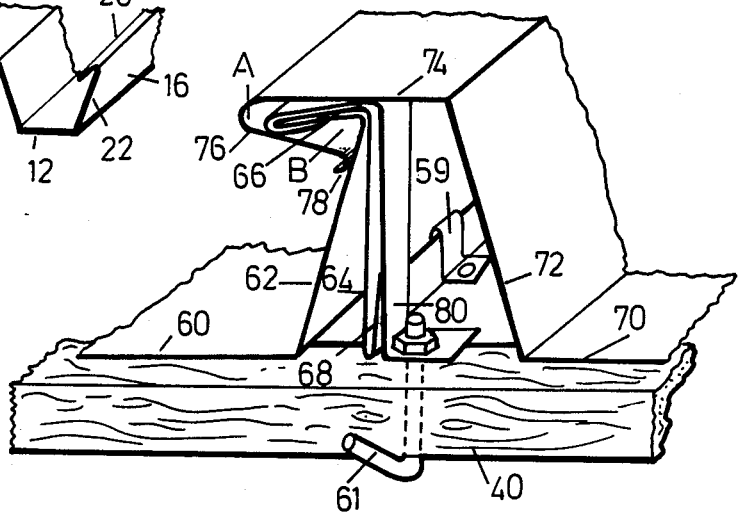
FIG. 2 shows an enlarged scale, an oblique view of the joint area of adjacent roof sheets connected to each other and to a roof frame.
Figure 3:
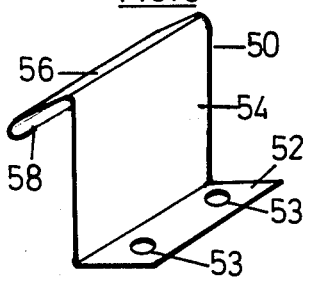
FIG. 3 shows an oblique view of an embodiment of cleat for use with the invention.

FIG. 2 shows how the roofing sheet of FIG. 1 is installed on a roof frame including a purlin 40 which extends substantially transversely to the elongate ridges of the roof sheet. Roof cladding or sheets 60 and 70 are secured to roof frame purlin, 40, by a cleat 50, (which may be wider, as shown in FIG. 3), and a hook bolt 61. The edge formation of the sheet 60 includes an inclined flank 62, a lock flange 66, and a substantially vertical flank 64, with the lock flange being bent through 105° from the flank 64 to slope downwardly towards the valley of the sheet. An upward lip 68 on the free end of the flank 64 forms a water run-off gutter. The edge formation of the sheet 70 includes an inclined flank 72, a crest 74, a reentrant part 76 and a lip 78.

The crest 74 is substantially parallel to the va11eys of the sheets 60 and 70, at least when installed and the groove between the crest 74 and reenetrant part 76 receives the flange 66 with a resiliently stressed, snug fit. In practice the sheet 70 is installed by holding it inclined with the edge shown sloping downwardly, engaging the flange 66 in the groove, rotating the sheet 70 to be parallel to the sheet 60, and pulling the sheet 70 away from the sheet 60 so that the end of the lip 78 abuts the flank 62. This stresses the flanges 64 and 76 resiliently against each other and inhibits rattling of the roof cladding, a factor which experience has shown promotes withdrawal of fastening members such as nails. This construction also ensures that plenums A and B are formed in the joint which have a relatively large cross-section and which thus act as capilliary breaks, i.e. prevent the ingress of water through the joint under capilliary forces. The use of a cleat in the construction permits the roof sheets to expand or contract with changes in temperature without applying high forces to the fastening members. Cleat 59 shows an alternative which hooks onto the lip 68.

FIG. 3 shows a cleat 50 including a base part 52 formed with two holes 53 so that it may be secured to a roof frame, an upwardly extending body part 54, and a clamp part 56 having a returned lip 58 forming a groove which will receive the lock flange 26 of an edge rib.

Figure 4:
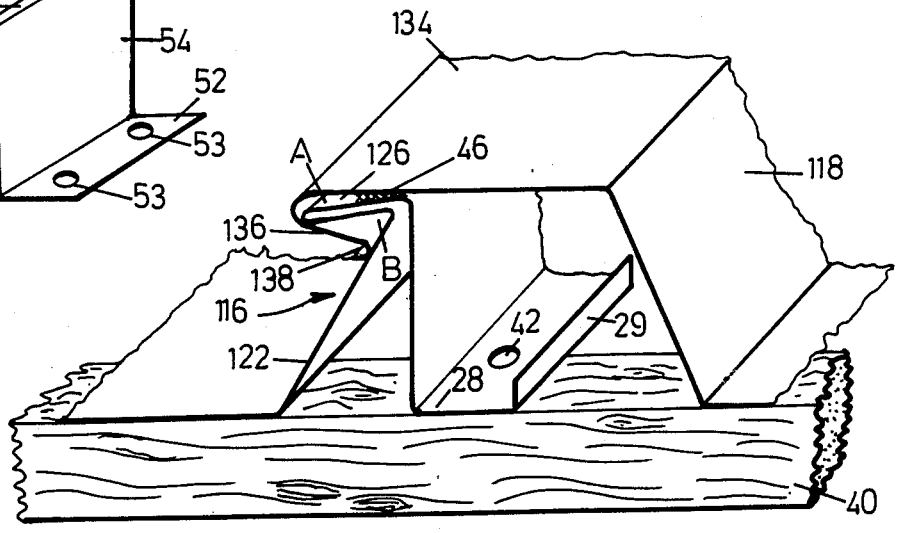
FIG. 4 shows an oblique view of a joint area of adjacent roof sheets in a roof construction according to another embodiment of the invention.

FIG. 4 shows an embodiment not using cleats. In this figure an edge formation 116 of one roof sheet is secured to the purlin 40 by means of a nail 42 that passes through a base portion 28. Of course, in appropriate situations the nail 42 and wooden purlin 40 would be replaced by metal section purlins and hook bolts in a known manner. The edge formation 118 of an adjacent roof sheet is locked to the first mentioned roof sheet which has already been secured to the roof frame, by means of engaging the groove of the reentrant part 136 of the edge formation 118 with the lock flange 126 of the edge formation 116. as shown the lip 138 engages with the flank 112 of the edge formation 116 to form a plenum B which is sufficiently large to prevent capilliary action of water which during a storm may be blown up the flank 122. Also as shown the lock flange 126 is sloped downwardly; this creates a second plenum A and is also to prevent water leaking through the joint between adjacent roof sheets. A layer of Mastic (proprietary name) or similar bituminous sealant 46 is provided between the flange 126 and crest portion 134. Base portion 28 has an upturned lip 29 which turns it into a gutter.

When installing a roof using the roof sheets described above, the roof sheets are installed sequentially in a lateral direction. In other words a roof sheet adjacent one edge is first secured in position on the roof frame including securing the edge formation 16. An adjacent roof sheet is then engaged with the already secured edge formation 116 and, in turn, has its edge formation 116 secured to the roof frame. In this way the roof sheets can be rapidly installed using a minimum of securing elements, each of which is concealed and unexposed to the elements.

The invention is not limited to the precise constructional details shown in the drawings and described herein and modifications may be made without departing from the spirit or scope of the invention. For example a cleat may be provided to engage the lip 68 only of a roof sheet. In this event a suitable sealant may be provided to seal the flange 64 in the groove between members 74 and 76 of an adjacent sheet. Also a pop rivet may connect the crest and lock flanges, the rivet preferably not extending right through the overlapping flanges.

I claim:

1. An elongate, transversely profiled roof sheet comprising:

at least one elongate ridge and flanking valleys, first and second edge formations along opposed elongate edges of the sheet adjacent the valleys, the first edge formation including juxtaposed first edge flanks meeting in a lock flange bent to extend inwardly and downwardly from the first edge flanks toward the adjacent valley generally in a direction toward the second edge formation, one of the first edge flanks having an upturned lip on its lower outer edge to provide a water run-off channel, the second edge formation incuding a second edge flank terminating in a crest bent to extend outwardly from the second edge flank away from the adjacent valley generally in a direction away from the first edge formation, the crest terminating in a reentrant bend extending to an edge lip to form a generally V-shaped groove extending inwardly and downwardly beneath the crest generally in a direction toward the second edge flank, the opening of the generally V-shaped groove being wider than the width of the lock flange, the lock flange being adapted to be received in the groove of an adjoining sheet with the sheets at an angle therebetween and resiliently engaging the adjoining sheet at two distinct locations within the generally V-shaped groove on the crest and intermediate the reentrant bend and edge lip, respectively, with the sheets in a common plane to thereby form a stessed joint to inhibit rattling, the edge lip engaging one of the first edge flanks with the sheets in a common plane, the engagement of the lock flange within the groove and the edge lip with the second edge flange forming two distinct plenums capable of providing capillary breaks to prevent water ingress by capillary action.

2. A roof sheet is claimed in claim 1, in which the juxtaposed first edge flanks form an inverted V-shape with one limb vertical.

3. A roof sheet as claimed in claim 1, provided in combination with a plurality of cleats for securing the roof sheet to a roof frame structure, each cleat being securable to a roof frame member and having a clamp portion for engaging a part of the first edge formation, the cleat incuding a base part formed with two holes so that it may be secured to a roof frame, an upwardly extending body part and a clamp part having a returned lip forming a groove which will receive the lock flange.

* * * * *